United States Patent [19]

Kibler

[11] 4,112,886

[45] Sep. 12, 1978

[54] ENGINE SPEED GOVERNOR

[75] Inventor: Roland G. Kibler, Flushing, Mich.

[73] Assignee: General Motors Corporation, Detroit, Mich.

[21] Appl. No.: 746,394

[22] Filed: Dec. 1, 1976

[51] Int. Cl.[2] ..... F02D 11/08

[52] U.S. Cl. ..... 123/103 R; 123/103 E

[58] Field of Search ..... 123/103 R, 103 E, 198 DB, 123/127

[56] References Cited

U.S. PATENT DOCUMENTS

| | | | |
|---|---|---|---|
| 3,018,766 | 1/1962 | Francis | 123/103 R |
| 3,021,827 | 2/1962 | Brunner | 123/103 R |
| 3,081,757 | 3/1963 | Cramer | 123/103 R |
| 3,596,642 | 8/1971 | Nakata | 123/103 R |
| 3,921,612 | 11/1975 | Aono | 123/103 R |

*Primary Examiner*—Charles J. Myhre
*Assistant Examiner*—Craig R. Feinberg
*Attorney, Agent, or Firm*—Arthur N. Krein

[57] ABSTRACT

An engine speed governor for an engine having a multi-stage carburetor includes vacuum operated first and second governor actuators operatively connected to the primary and secondary throttle valves, respectively, of the carburetor and connected by separate conduits to the primary intake passage of the carburetor for venturi vacuum to effect selective closing of the primary and secondary throttle valves, and a solenoid governor valve having a normally open, first port operatively connected to the first governor actuator, a normally closed, second port operatively connected to the second governor actuator and a third port open to the atmosphere, the solenoid governor valve being connected to an engine speed sensing means whereby when the engine is below governed speed, the solenoid governor is de-energized, allowing air to bleed into the first governor actuator to keep it in a non-governing position while allowing vacuum to build up in the second governor actuator for normal operation of the secondary throttle valve, when with increasing speed the engine operates close to governed speed the solenoid governor valve is duty cycled, and when the engine operates at or above a governed speed, the solenoid governor valve is energized to allow vacuum build up in the first governor actuator to effect closing of the primary throttle valve, while allowing bleed air to flow to the second governor actuator to permit closing of the secondary throttle valve.

2 Claims, 1 Drawing Figure

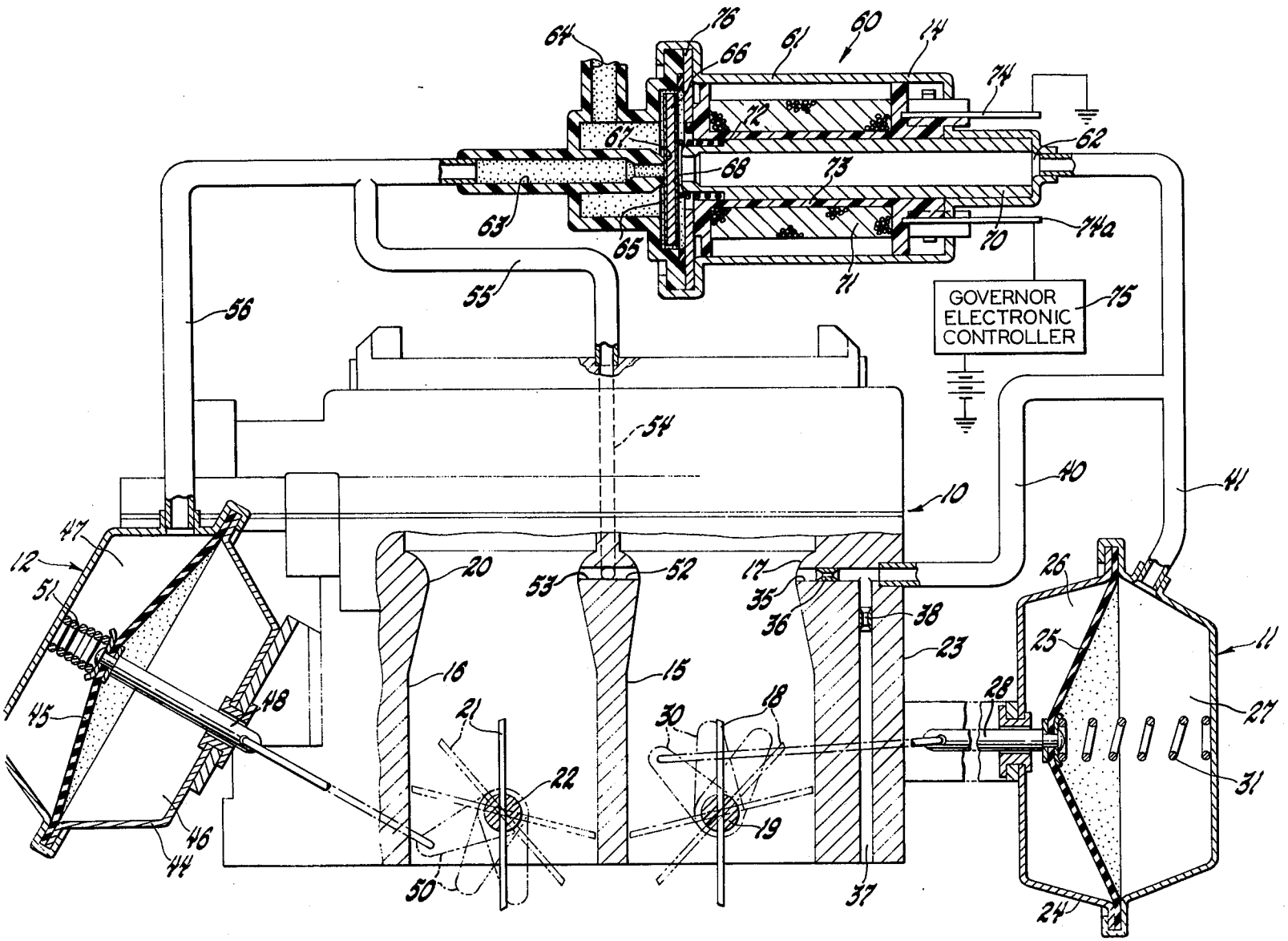
GOVERNOR
ELECTRONIC
CONTROLLER

ENGINE SPEED GOVERNOR

This invention relates to an engine speed governor for internal combustion engines and, in particular, to an engine speed governor for an internal combustion engine of the type having a dual or multi-stage carburetor.

It is a well-known practice to provide an engine speed governor on, for example, a truck engine using two-stage carburetion, as provided by the known two or four barrel carburetor, whereby the governor is operative to limit the engine speed to a predetermined maximum while still allowing full power output from the engine when required. Such a governor, which may be, for example, of the type shown in any one of U.S. Pat. No. 3,081,757 for "Multi-Stage Governed Fuel Device" issued Mar. 19, 1963 to Thomas F. Cramer or U.S. Pat. No. 3,249,099 for "Multi-Stage Carburetor" issued May 3, 1966 to Richard M Saxby, utilizes engine vacuum to provide the actuating force for its speed regulating function and the governor control is achieved by regulating the governor operating vacuum level.

As is well known, such an engine speed governor can be divided into two sub-systems, that is, a speed sensing and vacuum control unit and a carburetor control unit. With reference to the speed sensing and vacuum control unit, this sub-system senses the engine speed and, at speeds close to the governed speed, controls the governor vacuum level through an air bleed restriction. This sub-system may be either of the so-called centrifugal or spinner type, which is a mechanical device of the type shown in the above-identified U.S. Pat. No. 3,081,757 or it may be of the type which includes a governor electronic controller and a solenoid governor valve controlled thereby. In this latter type, as is well known, the engine speed is sensed by electronically counting the engine ignition pulses (which are proportional to engine speed) and controlling the air bleed by means of an electrical solenoid valve that is energized or de-energized by the governor electronic controller. With this arrangement, when above governed speed, the solenoid valve is energized (closed to bleed air) continuously; when below governed speed, the valve is de-energized (open to bleed air) continuously.

When such a governor electronic controller and solenoid governor valve is used in an engine speed governor system of the type shown, for example, in the above-identified U.S. Pat. No. 3,081,757, in lieu of the mechanical control device or governor valve assembly shown therein, the operation of such a system would be as follows:

At speeds well below governed speed, the governor valve is de-energized (open) allowing bleed air into the primary actuator and into the secondary dump or control valve and both primary and secondary throttles would operate normally.

At speeds above governed speed, the governor valve is energized (closed) allowing vacuum to build up in the primary governor actuator and the secondary dump or control valve. The primary governor actuator is then operative to close the primary throttles, while the secondary dump or control valve allows atmospheric air to bleed into the secondary governor actuator which is then operative to close the secondary throttles.

It will be apparent from the above description that in such governor systems of the prior art, as shown in the above-identified U.S. Pat. No. 3,081,757, a secondary dump or control valve must be used in the system to control the flow of atmospheric air into the secondary governor actuator during engine operation at speeds above governed speed to effect closing of the secondary throttles.

It is therefore a primary object of this invention to provide an improved engine speed governor in which a three-way solenoid valve is used to regulate the governor operating vacuum level supplied to the primary and secondary governor actuators for the primary and secondary throttle valves, respectively, in a two-stage carburetor.

Another object of this invention is to provide an improved engine speed governor system whereby the need of a secondary dump or control valve in such a system is eliminated.

Another object of this invention is to provide an engine speed governor system wherein the governing control valve of the system is a three-way solenoid actuated valve having a normally open port connected to one governor actuator and a normally closed port connected to another governor actuator whereby these governor actuators are selectively actuated.

These and other objects of the present invention will be more apparent from the following description to be read in connection with the accompanying drawing, wherein:

The single FIGURE shown is a view, partly schematic, of a carburetor with engine speed governor in accordance with the subject invention, the respective elements thereof being shown in their below governed speed positions.

Referring now to the drawing, there is shown a two-stage carburetor 10 which, in accordance with the invention, has the positioning of the primary and secondary valves thereof controlled by a primary governor actuator or vacuum motor 11 and a secondary governor actuator or vacuum motor 12, respectively, and, in accordance with the invention, a three-way solenoid type governor valve 14 being used to regulate the governor operating vacuum level supplied to the governor actuators, in a manner to be described, whereby to limit engine speed.

The two-stage carburetor 10 for an internal combustion engine may be of the type, for example, as shown in the above-identified U.S. Pat. No. 3,081,757 and, accordingly, is only shown schematically in the drawing since it is not deemed necessary to illustrate or describe all of the details thereof for an understanding of the subject invention. However, for a complete disclosure of the details of such a carburetor, reference is made to the above-identified U.S. Pat. No. 3,081,757, the disclosure of which is incorporated herein by reference thereto.

As shown, the carburetor 10 has at least one primary intake passage or barrel 15 and at least one secondary intake passage or barrel 16. The primary barrel 15 is provided with a restriction or venturi 17 and with a manually operated primary throttle plate or valve 18 downstream thereof, which throttle valve is mounted on a primary throttle shaft 19 whereby the primary throttle valve can be operator controlled in the usual manner by a linkage, not shown. The secondary barrel 16 is also provided with a restriction or venturi 20 and with a secondary throttle valve 21 downstream thereof, the secondary throttle valve being mounted on a secondary throttle shaft 22.

The primary governor actuator or vacuum motor 11, used to control the primary throttle valve 18, may be formed as a part of the body 23 of the carburetor or, as shown, it may be a separate unit suitably mounted on the body 23 of the carburetor and, in the construction shown, includes a two-piece housing 24 having the interior thereof divided by a flexible diaphragm 25 secured at its perimeter between the two parts of the housing. The diaphragm 25 divides the interior of the housing 24 into a pressure chamber 26 in open communication with the atmosphere and a vacuum chamber 27. A rod linkage 28 is suitably secured at one end to the center of the diaphragm 25 and is pivotally connected at its opposite end to a lever 30 fixed to the primary throttle shaft 19.

A governor spring 31 is operatively connected to the lever 30, as for example, in the manner shown in the above-identified U.S. Pat. No. 3,081,757, but for purpose of illustration only, this governor spring 31 is shown schematically as positioned in the vacuum motor 11. The governor spring 31 is operative to bias the primary throttle plate 18 to follow the throttle lever, not shown, which is part of the usual conventional linkage, not shown, by which the operator can control the opening and closing of the primary throttle lever. Thus, as is well known, the governor spring 31 is operative to tend to hold the primary throttle valve 18 in the open position so long as and to the degree that the usual foot throttle or accelerator pedal (not shown) is depressed. As is well known, the throttle lever, not shown, which is controlled by the operator, is connected to the primary throttle shaft in such a manner that, when the engine is operating below governed speed, the governor spring 31 will cause the primary throttle valve 18 to follow the throttle lever.

An orifice 35 at the throat of the primary venturi 17 and an orifice 37 opening into the barrel 15 downstream of the primary throttle valve 18 have fixed restrictions 36 and 38, respectively, and are connected by a vacuum conduit 40 and a conduit 41 to be in flow communication with the vacuum chamber 27 of the vacuum motor 11 whereby a vacuum signal can be applied to one side of the diaphragm 25 so as to effect movement of the primary throttle 18 in a closing direction against the biasing action of the governor spring 31.

The secondary governor actuator or vacuum motor 12 is suitably mounted at the opposite side of the throttle body 23 and, in the construction shown, includes a two-piece housing 44 having the interior thereof divided by a flexible diaphragm 45 secured at its outer peripheral edge between the two parts of the housing. This diaphragm 45 divides the interior of the housing 44 into a pressure chamber 46 in open communication with the atmosphere and a vacuum chamber 47. A rod linkage 48, suitably secured at one end to the center of the diaphragm 45, is pivotally connected at its opposite end to a lever 50 fixed to the secondary throttle shaft 22. An actuator spring 51 is positioned in the vacuum chamber 47, with one end of the spring abutting against a portion of the housing 44 and its other end against the diaphragm 45, whereby to normally bias the diaphragm in a direction to effect movement of the rod linkage 48 in a secondary throttle valve 21 closing direction.

An orifice 52 in the throat of the primary venturi 17 and an orifice 53 in the throat of the secondary venturi 20 both communicate with one end of a common vacuum passage 54 extending through the throttle body 23, with the opposite end of this vacuum passage 54 being connected by a vacuum conduit 55 and a conduit 56 to the vacuum chamber 47 of the secondary governor actuator or vacuum motor 12, whereby vacuum can be applied to this vacuum chamber as a function of the air flow through the barrels of the carburetor 10.

Now in accordance with the invention, in order to selectively regulate the operating vacuum level in the vacuum chambers 27 and 47 of the vacuum motors 11 and 12, respectively, there is provided a governor valve assembly, in the form of a three-way solenoid governor valve 60 that has its normally open port operatively connected to the conduit 41 leading to the vacuum chamber 27 of the primary governor actuator or vacuum motor 11 and its normally closed port connected to the conduit 56 leading to the vacuum chamber 47 of the secondary governor actuator or vacuum motor 12 whereby the vacuum chambers of these vacuum motors can be selectively placed in communication with bleed air at atmospheric pressure.

The three-way solenoid governor valve 60, which may be located at any desired position on the engine, may be of any known construction suitable for the intended function, to be described, and in the construction shown, is a commercially available, variable duty cycle solenoid control valve of the type disclosed in copending U.S. patent application Ser. No. 632,399, filed on Nov. 17, 1975, in the name of John W. Riddel, entitled "Pressure Control Valve", now U.S. Pat. No. 4,005,733 and assigned to the common assignee, the disclosure of which is incorporated herein by reference thereto.

Thus, in the embodiment shown, the solenoid governor valve 60 includes a housing 61 having a first or normally open port 62 connected by the conduit 41 to the vacuum chamber 27 of vacuum motor 11 and to the vacuum conduit 40, a second or normally closed port 63 connected by conduit 56 of the vacuum chamber 47 of vacuum motor 12 and to the vacuum conduit 55 and, a third port 64 which is in open communication with the atmosphere, preferably through an air filter, not shown.

The housing 61 of governor valve 60 has a valve chamber 65 therein in which a magnetic reed valve 66, which acts as a solenoid armature, is positioned, the valve chamber 65 being in open communication with the third port 64. The second port 63 opens into the valve chamber 65 through a valve seat 67 which is engageable by the valve 66. Another valve seat 68, positioned on the opposite side of the valve 66 from valve seat 67 and axially aligned therewith is part of a tubular solenoid core 70 of a solenoid 71, with this tubular solenoid core serving as an extention of the first port 62 in communication, as controlled by the valve 66, with the valve chamber 65. A spring 72 encircling a reduced portion of the tubular solenoid core 70 abuts at one end against a shoulder of this core and at its other end against the valve 66 to normally bias this valve into seating engagement with the valve seat 67, this occuring, of course, when the solenoid is de-energized. The solenoid 71 includes a coil wound on a suitable bobbin 73 and is provided with electrical terminals 74 and 74a connected to an electrical circuit having a conventional, commercially available, governor electronic controller 75, whereby the solenoid can be energized or de-energized as a function of engine speed, in a manner known in the art. In addition, a solenoid field plate 76, of apertured disc shape, is positioned adjacent one end of the solenoid core 70 and adjacent chamber 65, with the valve seat 68 extending axially outward of plate 76 into chamber 65.

As is well known, the governor electronic controller 75, in normal operation, compares the ignition pulses, as from a high energy ignition distributor, not shown, to an internal reference, which is proportional to the desired governor speed setting for a particular engine. When these ignition pulses, which are proportional to engine speed, exceed this reference, current will flow to the solenoid 71 of the governor control valve 60 so as to energize the solenoid and effect movement of the valve 66 from the position shown, into engagement with the valve seat 68, against the biasing action of the spring 72. The signal from the controller 75 is delivered to the solenoid 71 to energize and de-energize it in an appropriate duty cycle, as desired, to move the valve 66 and permit predetermined quantities of atmospheric bleed air entering through the port 64 to flow either through the port 62 or port 63 to the vacuum motors 11 and 12, respectively, and at well below governed speed, the solenoid 71 is de-energized continuously and, well above governed speed, the solenoid is energized continuously.

Thus in operation, when the solenoid 71 of the governor valve 60 is de-energized continuously, the normally open port 62 is in communication via the chamber 65 with the port 64, whereby atmospheric air can flow toward the vacuum chamber 27 and thus, in effect, the vacuum chamber 27 is open to bleed air. At the same time, the valve 66, biased by spring 72 into engagement with the valve seat 67, prevents the flow of air from the port 64 and chamber 65 to the port 63 and, accordingly, the vacuum chamber 47 of the suction motor 12 will be subject to vacuum pressure as generated in the primary venturi 17 and then in the secondary venturi 20 to permit normal operation of the secondary throttle valve. These are the positions of the actuators and of the governor control valve shown in the drawing.

Well above governed speed when the solenoid valve 71 of the governor control valve 60 is energized continuously, the valve 66 will be moved out of seating engagement with the valve seat 67, against the biasing action of spring 72, into seating engagement against the valve seat 68. When this occurs, the bleed air to the vacuum chamber 27 of the primary governor actuator or vacuum motor 11 is shut off allowing vacuum to build up therein as produced by the air flow through the primary barrel 15, that is, by the vacuum sensed therein at the orifices 35 and 37. When sufficient vacuum is established in the vacuum chamber 27 to overcome the biasing action of the governor spring 31, the primary governor actuator 11 then operates to close the primary throttle valve 18. At the same time, with the unseating of the valve 66 from the valve seat 67, the port 63 is then placed via the chamber 65 in communication with the port 64 whereby atmospheric air can flow to the vacuum chamber 47 of the secondary governor actuator 12 to dissipate the vacuum pressure whereby to effect substantial equalization of the pressures on opposite sides of the diaphragm 45 permitting the governor spring 51 to then effect movement of the diaphragm in a direction to effect closing of the secondary throttle valve 21 through the linkage and lever arrangement, previously described.

In addition, the governor electronic controller 75, which senses the engine speed, is operative so that at speeds close to the governed speed, it controls the operation of the governor valve 60 to vary the air bleed to the vacuum motors 11 and 12. Thus, during operation, at well below the governed speed, there is maximum air flow through the port 64, normally open port 62 and conduit 41 to the vacuum chamber 27 and, therefore, the governor vacuum level in the vacuum motor 11 will be low and this primary governor actuator will not operate and, accordingly, the operation of the carburetor and therefore of the engine is under direct control of the operator.

However, with increasing engine speed, at some point close to governed speed, the solenoid governor valve 60 will be duty cycled by operation of the governor electronic controller 75 so as to restrict the air bleed to the vacuum chamber 27 of vacuum motor 11 and, as the speed increases further, the restriction, and thus the vacuum level in the vacuum chamber 27 of vacuum motor 11, increases in the manner previously described so that at the predetermined governed speed, the vacuum level in the vacuum chamber 27 will be sufficient to enable the vacuum motor 11 to effect closing movement of the primary throttle valve 18 to maintain the desired governed speed. At the same time, as the solenoid governor valve 60 is duty cycled, restricted air bleed will begin to flow to the vacuum motor 12 to slowly dissipate or weaken the vacuum level in the vacuum chamber 47 thereof and, as the speed increases further, more bleed air is permitted to flow to further dissipate and weaken the vacuum level in the chamber 47 so that at the governed speed, the spring 51 in this vacuum motor can effect closing movement of the secondary throttle 21. Of course, as previously described, above governed speed, the solenoid governor valve 60 is energized continuously.

It will thus be apparent that this system can be calibrated, as by calibration of restrictions 36 and 38, to provide for a smooth transition from an increasing speed mode to a constant, maximum, governed speed mode.

Although only single primary and secondary barrels of the carburetor 10 have been illustrated and described, it will be apparent to those skilled in the art that the carburetor 10 can be either a two-barrel or a four-barrel carburetor.

What is claimed is:

1. An engine speed governor for an internal combustion engine having a carburetor wherein the carburetor includes a primary intake passage having a venturi and a primary throttle valve for controlling the flow of fluid therethrough, a secondary intake passage having a venturi and a secondary throttle valve therein, said engine speed governor including a vacuum actuated first governor actuator operatively connected to said primary throttle valve, governor spring means operatively connected to said primary throttle valve to bias said primary throttle valve in a valve opening direction, a first conduit, including orifice passage means, connecting said first governor actuator to said primary intake passage whereby said first governor actuator can be actuated by primary venturi vacuum for closing said primary throttle valve against the biasing action of said governor spring means, a vacuum actuated second governor actuator operatively connected to said secondary throttle valve, a second conduit connecting said secondary governor actuator to at least said primary intake passage whereby said second governor actuator is actuated by primary venturi vacuum to permit normal secondary throttle valve operation, resilient means operatively connected to said secondary throttle valve for normally biasing said secondary throttle valve toward a closed position; and a three-way, solenoid governor valve having a normally open port, a normally closed port and a port open to the atmosphere, said solenoid governor valve having said normally open port connected to said first conduit and said normally closed port connected to said second conduit, said solenoid governor valve being operatively connectable to an electrical power source through an engine speed sensing means whereby during operation of the engine when the engine speed is below governed speed, said solenoid governor control valve will be de-energized thus allowing air to bleed into said first governor actuator keeping it in a non-governing position while allowing vacuum to build up in said second governor actuator to permit normal operation of said secondary throttle valve; whereby when with increasing engine speed the engine operates close to governed speed said solenoid valve can be duty cycled so as to restrict air bleed to said first governor actuator and to allow restricted air bleed to flow to said secondary governor actuator; and, whereby when the engine operates above a governed speed, said solenoid valve can be continuously energized so as to shut off the flow of bleed air to said first governor actuator thereby allowing primary venturi vacuum to effect operation of said first governor actuator to close said primary throttle valve while allowing bleed air to flow to said second governor actuator whereby to permit said resilient means to close said secondary throttle valve.

2. An engine speed governor for the carburetor of an internal combustion engine, the carburetor having a primary intake passage having a venturi and an operator actuated primary throttle valve positioned therein for controlling the flow of fluid therethrough and a secondary intake passage having a venturi and a secondary throttle valve therein, a governor spring operatively connected to the primary throttle valve whereby the primary throttle valve is normally positioned to follow the operator's positioning thereof, said engine speed governor including a first vacuum motor operatively connected to said primary throttle valve, a first conduit, including orifice passage means connecting said first vacuum motor to said primary intake passage whereby said first vacuum motor can be actuated by primary venturi intake vacuum for closing said primary throttle valve, a second vacuum motor operatively connected to said secondary throttle valve, said second vacuum motor including resilient means therein operative to normally bias said secondary throttle valve for closing said secondary throttle valve, a second conduit connecting said second vacuum motor to said primary intake passage whereby said second vacuum motor can be actuated in part by primary venturi intake vacuum for opening said secondary throttle valve against the biasing action of said resilient means and, a solenoid governor valve having a normally open port connected to said first conduit, a normally closed port connected to said second conduit and a third port open to the atmosphere, said solenoid governor valve being operatively connectable to an electrical source of power through an engine speed sensing means whereby during operation of the engine, when the engine speed is below governed speed, said solenoid governor valve is de-energized whereby atmospheric bleed air can flow from said third port through said normally open port to said first vacuum motor to render said first vacuum motor inoperative at above governed speed, when the engine is above governed speed, said solenoid governor valve is continuously energized with said normally open port then being closed and said normally closed port then being open whereby said second vacuum motor is rendered inoperative and said resilient means is operative to effect closing of said secondary throttle and whereby venturi vacuum can build up in said first vacuum motor to effect closing of said primary throttle valve, and when the engine speed increases to a speed close to governed speed said solenoid governor valve is duty cycled whereby to restrict atmospheric air bleed flow to said first vacuum motor while allowing restricted atmospheric air bleed flow to said second motor.

* * * * *